US006540098B1

(12) United States Patent
Jarvis et al.

(10) Patent No.: US 6,540,098 B1
(45) Date of Patent: Apr. 1, 2003

(54) FOOD PAN COVER WITH SLIDING LID

(75) Inventors: Charles W. Jarvis, Irvine, CA (US); Paul Dowd, Bronxville, NY (US); Terry L. Burdick, Fountain Valley, CA (US)

(73) Assignee: Cambro Manufacturing Company, Huntington Beach, CA (US)

( * ) Notice: Subject to any disclaimer, the term of this patent is extended or adjusted under 35 U.S.C. 154(b) by 0 days.

(21) Appl. No.: 09/841,922

(22) Filed: Apr. 25, 2001

(51) Int. Cl.[7] ..... B65D 43/12; B65D 43/20

(52) U.S. Cl. ..... 220/345.4; 220/254.1

(58) Field of Search ..... 220/254.1, 254.9, 220/345.4, 345.1, 255, 812, 813, 574, 575; 206/267, 246; 312/135.2

(56) References Cited

U.S. PATENT DOCUMENTS 1,090,264 A * 3/1914 Adams ..... 206/267
2,304,214 A * 12/1942 Straub ..... 188/69
4,819,829 A * 4/1989 Rosten et al. ..... 220/254.9
4,842,138 A * 6/1989 Sandel et al. ..... 206/363
5,107,990 A * 4/1992 Wicherski et al. ..... 206/1.5
5,458,256 A * 10/1995 Opheim ..... 220/345.3
5,673,811 A * 10/1997 Dickinson et al. ..... 220/345.4
5,938,062 A * 8/1999 Paramski ..... 220/222

* cited by examiner

*Primary Examiner*—Stephen K. Cronin
*Assistant Examiner*—Lien Ngo
(74) *Attorney, Agent, or Firm*—George F. Bethel

(57) ABSTRACT

A food pan and cover, the food pan having a peripheral web and a wall extending upwardly from the web on which the cover is seated. The cover has an opening that receives a sliding lid. A rail on the cover supports a flange on the lid and a keyway formed between the cover and the pan supports a key on the lid for sliding movement in the keyway. Stops at either end of the keyway check sliding movement of the lid. A wall substantially surrounds the lid on the upper surface with a conduit which extends beyond the opening of the cover for removal of liquid therefrom. A relieved notch portion on the lid allows for turning movement of the lid in the opening of the cover for placement and removal.

22 Claims, 5 Drawing Sheets

FOOD PAN COVER WITH SLIDING LID

BACKGROUND OF THE INVENTION

1. Field of the Invention

The field of this invention lies within the food pan, cover, and lid art wherein a cover is utilized for a pan of food. More particularly, it is within the art of maintaining food in a safe, fresh, and clean environment in a food pan wherein a lid can be removed in whole or in part for exposing the food for food service. Such food pans, lids, and covers are utilized within the field of institutional food service such as restaurants, fast food restaurants, hospitals, schools, banquet facilities, and other related institutional food service activities.

2. Prior Art

The prior art with regard to food pans, containers, and related lids, and covers have involved multiple configurations made of various materials. In this particular case, the food pans, covers, and lids related to this invention are generally in the plastic food service area.

Such food pans, lids, and covers usually rely upon a flange or surface upon which the lid or cover can rest on the pan. Also, there have been various means of closing the food pan covers and opening them with living hinges or other types of hinges.

In addition thereto, various flanges and inter-nesting locking means have been utilized in order to secure a cover to a food pan which can then be removed for food service.

Such covers and lids sometimes have a snap over feature with regard to various plastic connections. Also, it is known to have a cover with a flexible interior channel that seats on top of a food pan or food container. Further to this extent, food pans sometimes have lids or covers which pivot or turn from one particular point to another or have interior oriented walls that seat within a container.

It is also know that certain containers can have nesting configurations with respect to various seating relationships for providing a cover over the pan.

Many of the foregoing configurations including the pans, hinges, and lids have a drawback with regard to being maintained in a sanitary condition as well as ease of placement and function.

This particular invention has a sliding feature which secures a sliding lid into relationship with a food pan cover. The sliding lid within the cover provides for opening of the cover and access to the food within the pan. The sliding lid can be slid open and removed at will for access. Further to this extent, the sliding lid is indexed and secured to the cover by means of various interfacing securements.

In addition thereto, the lid of this invention provides for drainage and removal of food thereon so that it will not be left to fall or drip into the food pan. Also, a simplified sliding rail engagement creates a closure which easily glides backwardly and forwardly for supporting and providing access when the lid is slid within the cover.

The cover and the lid are easily inserted and matched with each other for removal and insertion by a unique support mechanism provided by the lid in association with the cover. Additionally, the cover provides for a rail support with the lid for holding and allowing easy removal and initial engagement as will be seen hereinafter.

Additional features of the lid and flanges allow the sliding and locking of the lid. The lid can be easily disassembled from the cover and the cover from the pan to provide for cleaning and sanitary maintenance. As a consequence, this invention is a step over the art providing ready and facile coverage of food within a pan.

SUMMARY OF THE INVENTION

In summation, this invention comprises a food pan and cover combination with a sliding lid within the cover that slides on rails, flanges, keyways, or supports and has specific stops and locks so that the lid can be slid open in an easy manner and at the same time disassembled for cleaning and maintenance of sanitary conditions.

More specifically, the invention provides for a cover that is indexed and seated on a food pan. Within the cover, a lid is supported in part thereon as well as on the food pan. The lid can slide backwardly and forwardly for providing access to an opening within the cover. As the lid slides backwardly and forwardly for access, it is supported on one portion by the cover and on the other portion on the top of the food pan in a keyway formed between the cover and pan.

Stops and indexing points are provided on the cover for stopping the lid at an appropriate position. Also a seating of the lid against locking projections of the cover is provided. Further to this extent, the locking positions maintain the lid in a relatively fixed position until it is slid into a position to provide access. This is accomplished by a handle across the trailing edge of the lid.

The lid also has a lip extending around its periphery which protects the interior contents of the food from exposure to other food or liquids dropping into the pan. The edge of the lid has drainage conduits or channels at either end to provide for removal of liquids and food so that they do not enter the food within the pan.

The lid is easily inserted into the cover through a geometry which allows the lid to be supported at one end on the cover. At an intermediate portion of the lid, a pair of rails, keys, flanges or extensions support the lid on the pan while at the same time allowing for removal and emplacement. The removal and emplacement features help to enhance the cleanliness and ability of the lid to be removed or placed in association with the cover.

DESCRIPTION OF THE PREFERRED EMBODIMENTS

Figure 1:
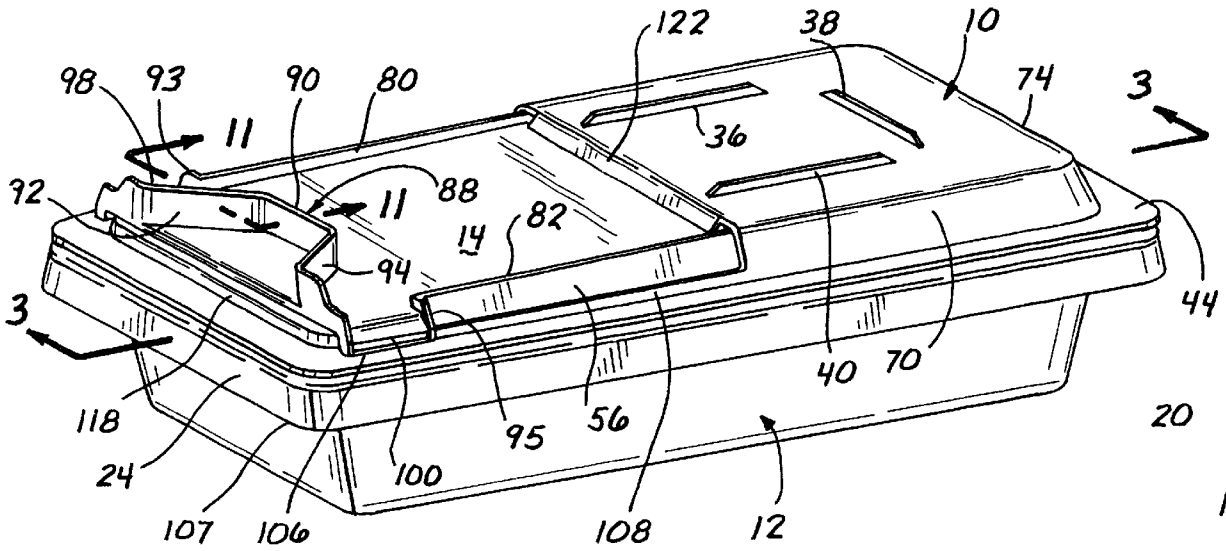
FIG. 1 shows a perspective view of a food pan and cover of this invention with the lid closed.
Figure 2:
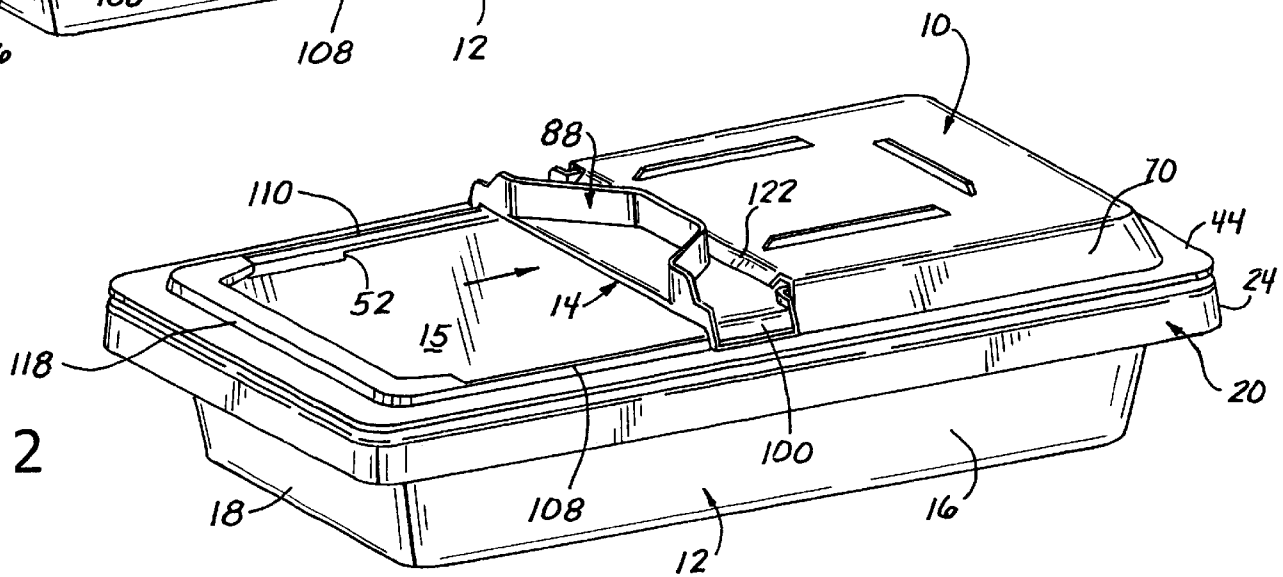
FIG. 2 shows a perspective view of the pan and cover as shown in FIG. 1 with the lid in a slid open position.

Looking more specifically at FIGS. 1 and 2 it can be seen that the invention hereof has been shown with the lid opened and closed. When looking at the figures, it can be seen that a cover 10 is shown overlaying a pan 12. The pan 12 is suitable for receiving food for storage and service therefrom. The pan 12 has a particular configuration which receives the cover 10 for a close fit and secured relationship to provide sanitary conditions for the storage of food.

The cover 10 has a lid 14 for covering an opening 15 in the cover. The lid 14 is shown in FIG. 1 in its closed position over the opening 15. In FIG. 2, the lid 14 is shown in its opened condition as it has been slid under a portion of the cover 10 which serves to uncover opening 15.

Looking more specifically at the pan 12, it can be seen that the pan has upright side walls 16 along the longitudinal portions and ends walls 18 at either end. The walls 16 and 18 are surrounded by a peripheral curved channel, formed by a skirt or wall 20 at the upper surfaces thereof. At the lower portion a bottom 19 extends between walls 16 and 18.

The curved channel with the wall 20 at the upper surfaces is formed by an extension, web or ledge 22 extending from the walls 16 and 18. The extension or web 22 turns downwardly into an outer wall portion 24. The outer wall portion 24 turns downwardly and forms the outside of the interior of the channel denoted as channel 25 with the extension 22 which can be described as a web, ledge or extension.

An outer upstanding, or surrounding wall, rib, rail, or ridge 28 is peripherally formed and extends upwardly from the plastic molded web, or extension 22. The web 22 peripherally surrounds the top of the channel 25.

The ridge or wall 28 serves to receive the cover 10 interiorly thereof in the manner to be described hereinafter. The cover 10 seats therein and is engaged for placement on top of the pan 12. Interiorly of the upstanding wall 28 is a ledge or interior web portion 30 which in part receives the cover thereon held in place by the surrounding wall 28.

Looking more specifically at the remaining portion of the pan 12 it can be seen that the bottom section or base 19 is shown. The base 19 extends on the bottom between the walls 16 and 18 to define a complete bottom closure. The base 19 also incorporates a series of ribs 34 which extend along the length. These ribs 34 not only help to reinforce the base 19 but also serve to provide for a positively placed positioning of the base 19 when one pan 12 is stacked on another with its cover 10.

The cover 10 can be seen with three upstanding ribs 36, 38, and 40. These three ribs help to stop the sliding of pans 12 on top of covers 10 when the pans are stacked with their covers on top of each other. The upstanding ribs, 36 and 40 receive the exterior of the longitudinal exterior of the ribs 34 when the pan 12 is stacked on top of the cover 10. The rib 38 blocks the end of the ribs 34 from moving beyond the positioning of the ribs so they do not slide forwardly on the cover 10. Thus, the pan 12 with its ribs 34 resting on the cover 10 can be held in place so it does not slide off the cover.

The cover 10 with the lid 14 are formed as two separate items. The cover 10 is formed with a singular peripheral flange, ledge or rib 44. This surrounding flange 44 extends around the periphery of the cover 10 and has an interiorly extending or depending wall, flange or rib 46. The interiorly extending or depending wall 46 seats within the interior periphery of the upstanding wall 28 so that the cover 10 can be held in place on top of the pan 12. The depending wall 46 is such where it permits rigidity at its outer area while at the same time managing to hold the cover 10 on the pan 12.

Figure 6:
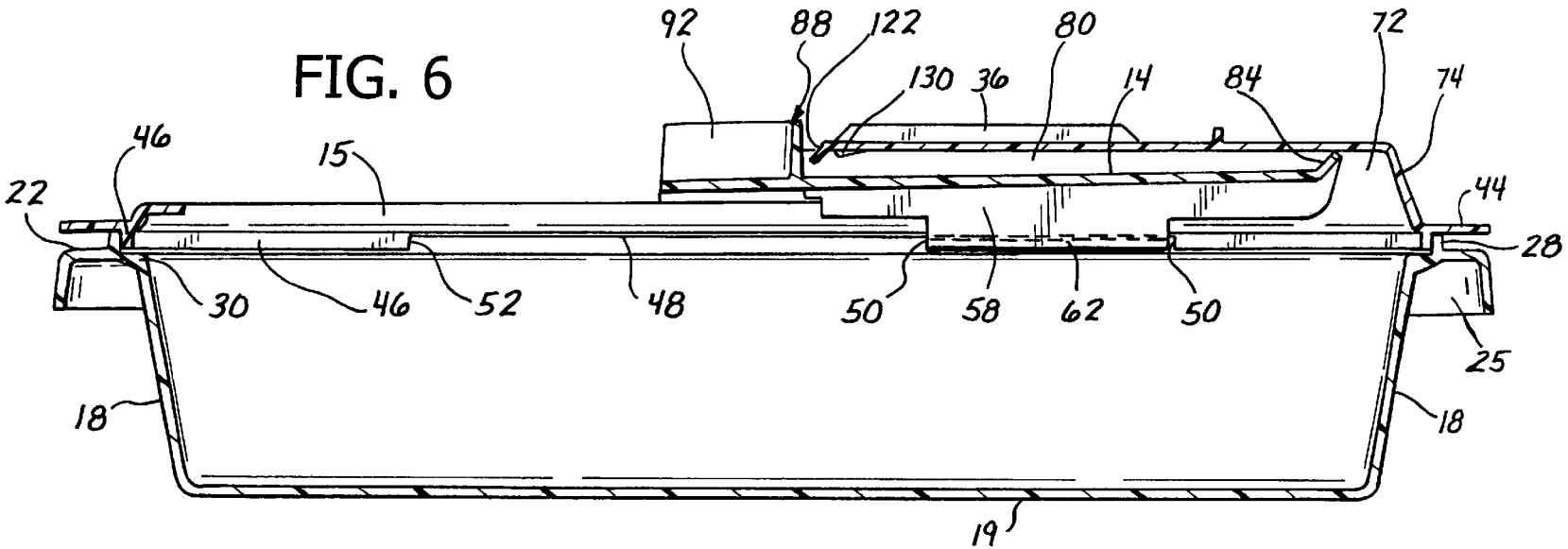
FIG. 6 shows a sectional view similar to FIG. 3 with the lid within the cover in an opened position.

The wall 46 has a longitudinal intermediate portion 48 which is reduced in height. This longitudinal intermediate portion 48 which is reduced in height terminates in a forward shoulder or stop 50 and a rearward shoulder or stop 52. These forward and rearward shoulders 50 and 52 block the movement of the lid 14 and secure it as to longitudinal travel. Thus, the lid 14 can move to the forward or interiorly oriented end as shown in FIG. 6 and is somewhat blocked against the shoulder 50.

When the lid 14 returns to the closed rearward, initial or leading position as seen in FIG. 1, it is blocked by the shoulder 52 in part. This enhances the overall movement of the lid 14 so that it is guided and indexed in its movement. At the same time, the shoulders or stops 50 and 52 provide indexing for seating the lid 14 in a particular location within the cover 10 on a usable basis.

Looking more specifically at the lid 14, it can be seen that a pair of sloping side walls 56 and 58 are shown. These sloping side walls 56 and 58 are such where they allow for protection of the food when the lid is in its closed position. The sloping walls 56 and 58 on either side are received on the interior of sloping walls 70 and 72 of the cover 10.

The walls 56 and 58 have an extending lateral portion, lateral extension, ledge, key, or edge member 60 and 62. These extending lateral portions or keys 60 and 62 are such where they underlie and interlock the lid 14. This keying is against the depending wall or edge portion 46 within the intermediate guide, keyway or slot area defined on either side of the cover 10 that has been provided by the reduced wall area 48. This keyed engagement allows the lid 14 with its extensions 60 and 62 to seat under the cover's downwardly extending wall portion 46 so that it slides thereunder along intermediate portion 48. The lid 14 is held in its indexed relationship by the movement under the depending wall 46 in its track or keyway 48 established between the shoulders 50 and 52.

The sloping side walls 56 and 58 of the lid 14 are received in sliding engagement within the sloping side walls 70 and 72 on either side of the cover 10. These sloping side walls 70 and 72 terminate at a forward or distal sloping frontal wall 74 which is at the terminal portion of the cover 10 removed from the opening 15. This forward sloping frontal wall 74 is such where it closes off the forward end of the cover 10 so that the cover and pan 12 can be integrated to seal the contents of the pan 12. Thus, the walls 56 and 58 of the lid 14 move inwardly and outwardly in such a manner as to be received in the open position shown in FIG. 2 therein and provide for extended coverage when the lid 14 is in the closed or rearward position of FIG. 1.

The top of the lid 14 incorporates an upstanding peripheral bead, surround, or wall formed by walls 80, 82, and 84. Walls 80 and 82 are on either side of the lid 14, while upright wall 84 is across the lateral forward portion of the lid 14.

The walls 80, 82 and 84 serve to protect against any incursion of food into the interior of the pan 12 when the lid 14 is closed such as in FIG. 1. In order to complete the wall and the protection provided thereby, a handle or rear wall portion 88 is provided. Rear wall 88 is formed of an upright forward portion 90 and two angular side portions 92 and 94. These two angular side portions 92 and 94 terminate in lateral walls on either side that depend downwardly on either side to form one side of a channel 98 and 100 on either side.

The channels or conduits 98 and 100 terminate in a downwardly curved arcuate portion between the terminal portion of the walls 92 and 94, and are bounded at the forward portions by complimenting walls 93 and 95. Thus the channels 98 and 100 are formed between lateral terminal portions of walls 92 and 94, and complimenting walls 93 and 95.

The walls 92 and 94, and complimentary walls 93 and 95 serve to form the channel or conduit 98 and 100. This allows for drainage of any material or liquids on top of the lid 14. In effect, the channels or conduits 98 and 100 create a gutter or downward flowing removal of food and liquid from the top of the lid 14. Food and liquids can be easily wiped to the edge of the lid 14 and removed.

The interior portions of the channels 98 and 100 provide for a rest, groove, or guide surface by virtue of a flange, arcuate rest, or finger shown at the end of channels 100 namely flange 106 formed with a groove 107. Flanges 106 with their grooves 107 allow for a curved depending seating of the interior of the channels 98 and 100. This provides for a rest, support, or catch for maintenance of the interior of the channels 98 and 100 on the grooves 107.

The flanges 106 with their grooves seat on a track or rail provided by upstanding walls or edges 108 and 110 that surround the opening 15 within the cover 10. The walls or track 108 and 110 receive the interior portion on the flanges 106 with their grooves 107 thereon to provide a rail like receipt. They act as guides for channelized indexing along the walls 108 and 110 as the lid 14 slides therealong.

Figure 3:
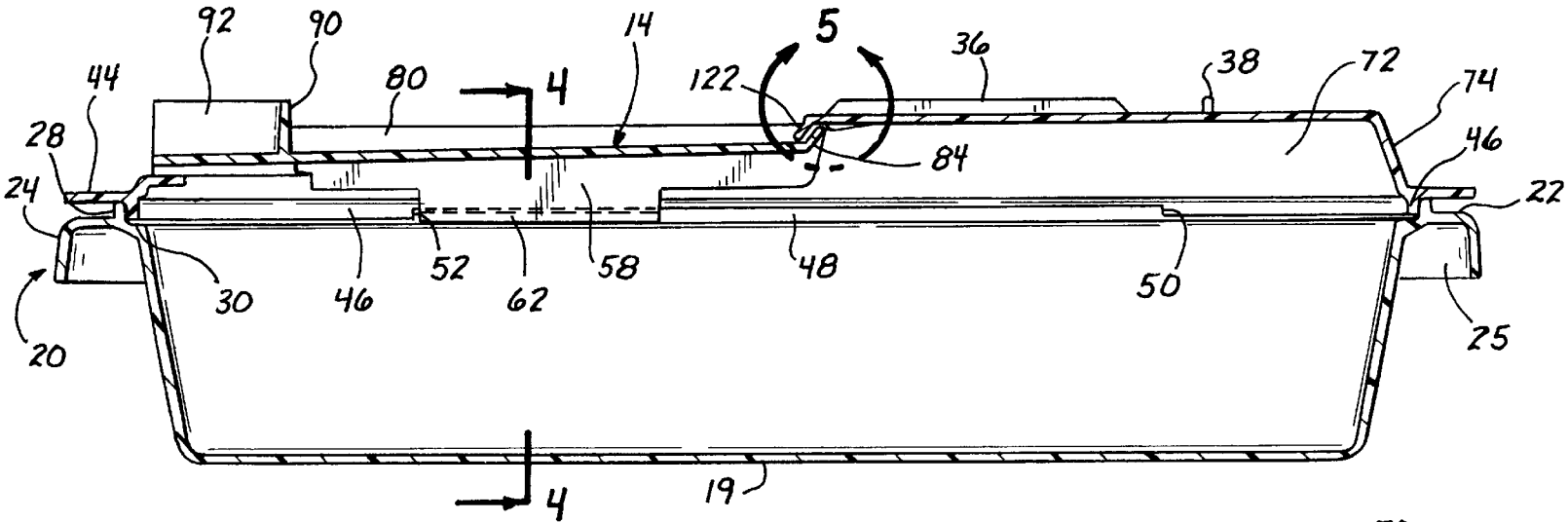
FIG. 3 shows a sectional view of the food pan and cover as sectioned along lines 3—3 of FIG. 1.
Figure 4:
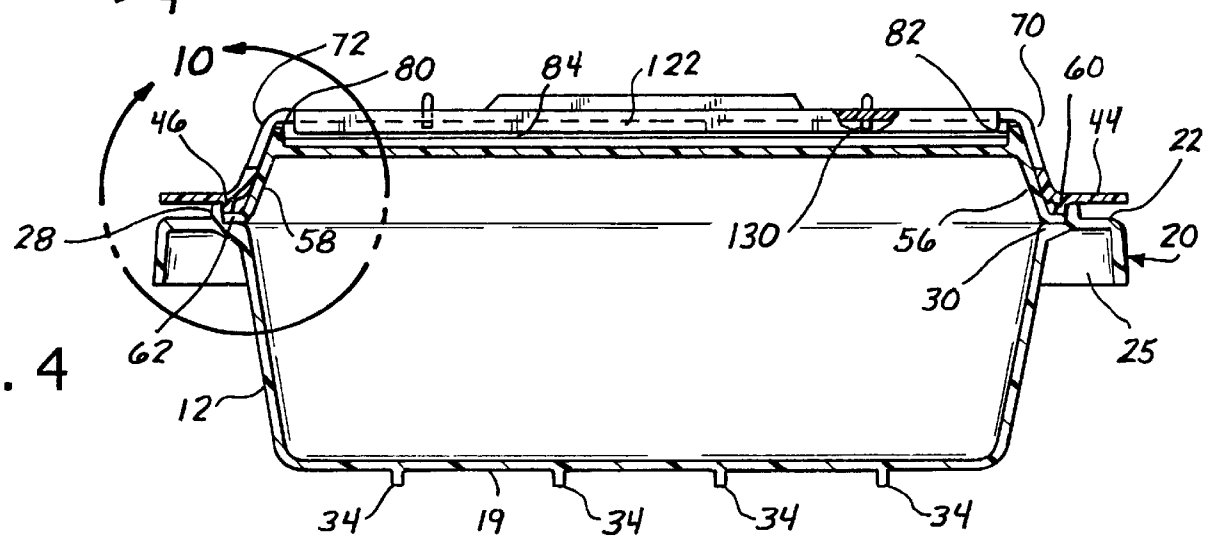
FIG. 4 shows a sectional view of the food pan and cover as sectioned in the directions of lines 4—4 of FIG. 3.
Figure 5:
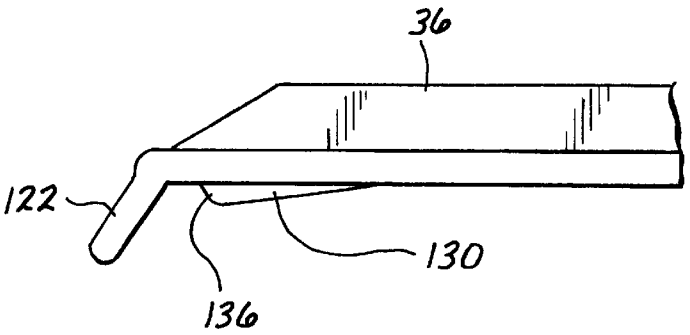
FIG. 5 shows an enlarged view from circle 5 of FIG. 3 of the food pan cover locking tabs for inhibiting movement of the lid in the closed position after it has been slid into the closed position.

A terminal covering wall 118 is provided which surrounds the opening 15 for purposes of completing the closure when the lid 14 is slid into its closed rearward position as shown in FIGS. 1 and 3. The terminal wall 118 joins with walls 80 and 82 to form a lateral closure and extend and fair into forward cover walls 70 and 72.

A depending wall on the top of the cover is shown in the form of depending wall 122. This depending wall 122 serves to receive the cover 10, and overly the wall 84 when the lid 14 is closed. The wall 122 also has the function of blocking food from passing to the wall 84.

The handle or wall portion 88 allows for removal and sliding of the lid 14 backwardly and forwardly. When the lid 14 is in the closed rearward position as shown in FIGS. 1 and 3, it rides into a retention area provided by a protuberance 130 extending from the interior of the cover 10. This protuberance 130 helps to lock the top surface or end region of the upright wall 84 on the lid 14. Thus the lid 14 is engaged by the tab or protuberance 130 when in the closed position so that it does not have a tendency to move forwardly in an involuntary manner. In order to move it over the protuberance 130, the sloping surface 136 allows the wall 84 to slide under the sloping surface 136 with minor effort.

As can be seen from the foregoing structure, the cover 10 rests on the pan 12 around the periphery thereof. The lid 14 on the other hand has the interior of the flanges 106 riding on the ridges or rails 1.08 and 110 that serve as guide rails allowing the lid 14 to slide backwardly and forwardly. The lid 14 at its intermediate portion is supported by means of the edge members or keys that laterally extend therefrom, namely edge members 60 and 62 that ride in the same manner on the pan interior web portion 30.

As a consequence, it can be seen that the lid 14 is supported in part and resting on the pan 12 at its interior intermediate portion by the keys 60 and 62 riding on interior portion 30 of web 22. This space between the top of the pan 12 and the cover 10 serves to provide a keyway for the extensions of keys 60 and 62 along intermediate portion 48. Thus the keys 60 and 62 are held in place for sliding movement between stops 50 and 52.

On the exterior portion the lid 14 is supported on the rails, ridges or upstanding walls 108 and 110. This allows for removal of the lid 14 from the cover 10 for cleaning and other servicing. The lid 14 need merely be removed by lifting up the cover 10 from the pan and letting the lid drop down from its support where it is normally supported on the pan 12 in the keyway along intermediate portion 48. The lid 14 is turned in the cover opening 15 so that the portion 106 of the downwardly turned flanges of the channels 98 and 100 can then be removed by turning.

Figure 7:
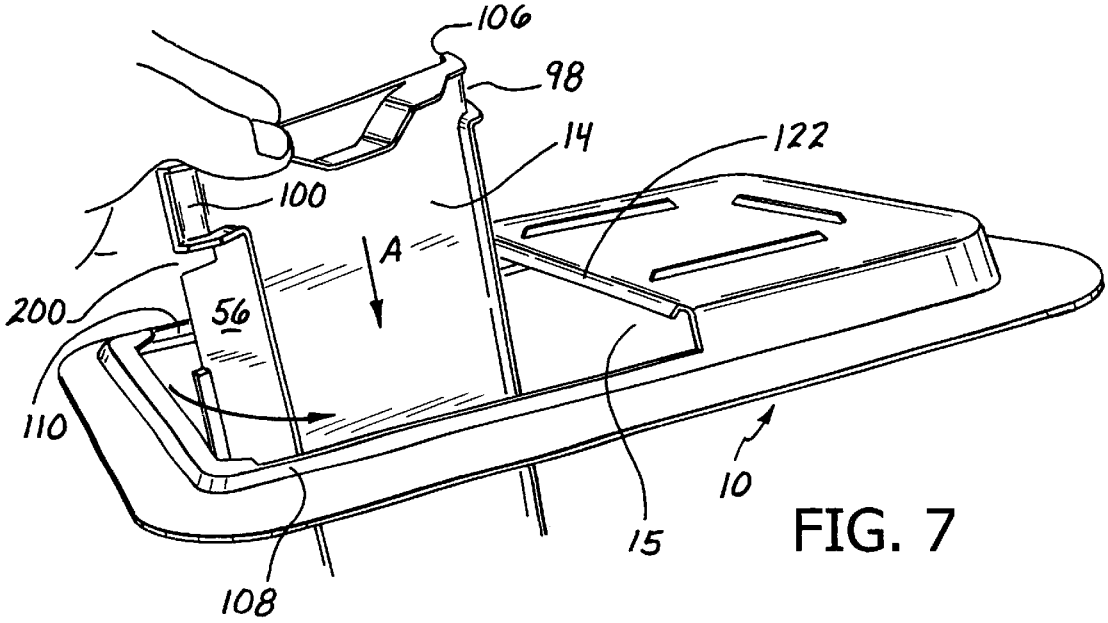
FIG. 7 shows a perspective view of the lid and cover with the lid initially being emplaced within the cover.
Figure 8:
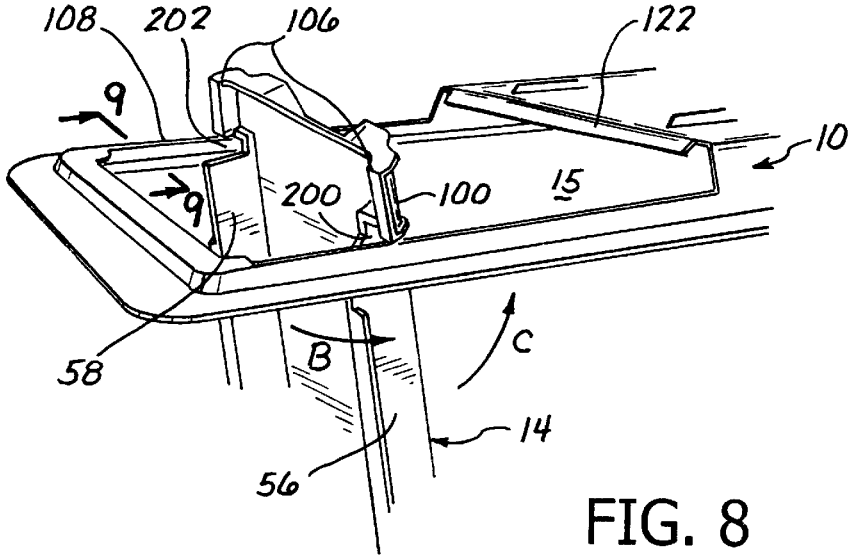
FIG. 8 shows a perspective view of the lid and cover with the lid having been emplaced in and on the cover before the forward end of the lid is placed in a resting position on the supports of the pan.
Figure 9:
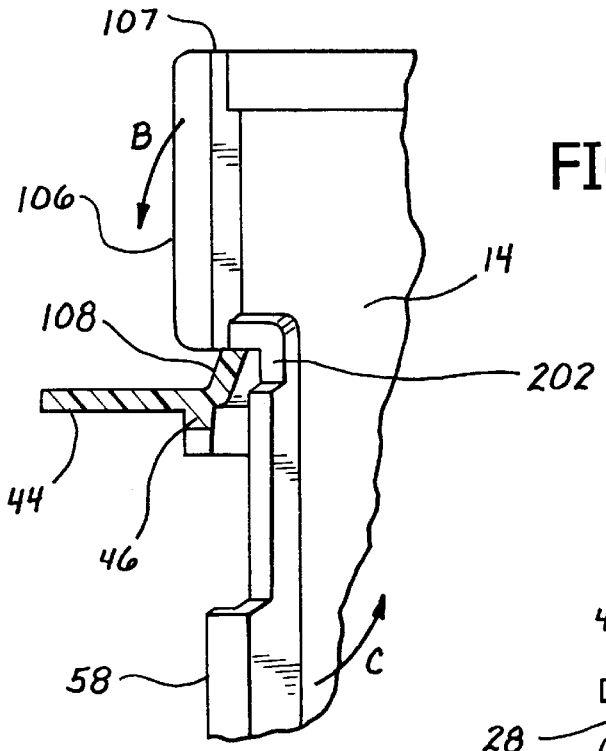
FIG. 9 is a partially cross-sectioned fragmented view detailing the engagement of the rear support of the lid on the cover in the direction of lines 9—9 of FIG. 8.
Figure 10:
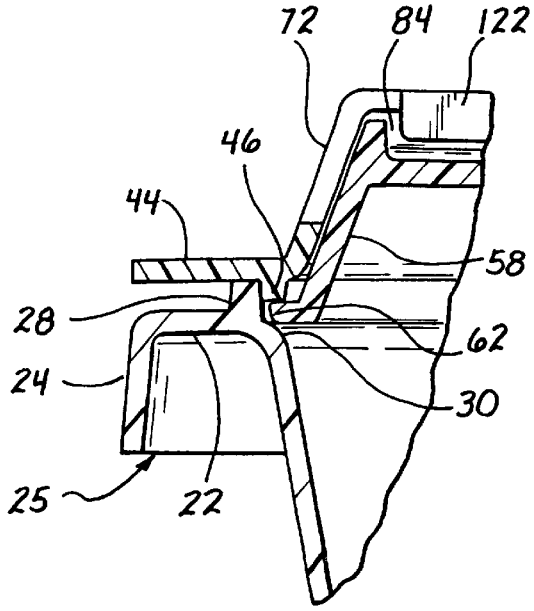
FIG. 10 is a detailed sectional view as encircled in FIG. 4.
Figure 11:
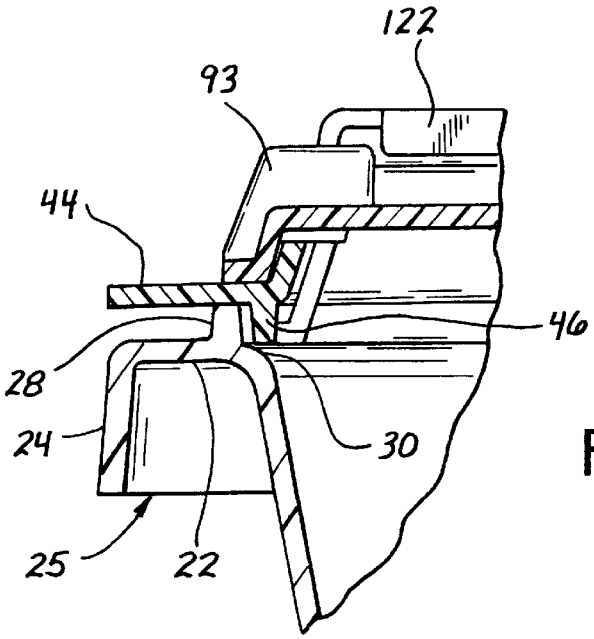
FIG. 11 is a sectional view of the rear area of the lid as sectioned in the direction of lines 11—11 of FIG. 1.

By way of illustration, an assembly of the lid 14, cover 10, and the pan 12 is shown in FIGS. 7, 8, and 9. In FIG. 7, it can be seen where the lid 14 is being emplaced within the opening 15 of cover 10 in the direction of arrow A as the first step. This is downwardly into the interior cavity or opening 15 of the cover 10.

After being placed in the direction of arrow A, notches 200 and 202 on either side are indexed to the side of the upstanding rails, ridges, walls or flanges 108 and 110 on the cover 10. This is done by rotating the lid 14 in the direction of arrow B. The notches 200 and 202 are formed in the sloping side walls 56 and 58 of the lid 14. Notches 56 and 58 are formed in the walls 56 and 58 just forward of the lateral channel walls 93 and 95. The notches 200 and 202 serve to accommodate a turning of the lid 14 within the opening 15 of the cover in order to seat the guides 106 with their grooves 107 on the rails or walls 108 and 110.

At this point, the notches 200 and 202 should be indexed on either side with the respective rail or flanges 108 and 110 on the cover. This positioning is seen in the perspective view of FIGS. 8 and 9.

In effect, movement in the direction of arrow B is seen as in FIGS. 7 and 8 turns the lid 14 in the proper direction in order to align the notches 200 and 202 with supporting surfaces of supports 106 with their grooves 107 in the interior portion of channels. 98 and 110. Alignment with the rails or side walls 108 and 110 and resting flanges 106 and grooves 107 of the lid 14 thereon supports the lid at the rear portion. At this point, the lid 14, can be balanced on either side rail at the extension or rest 106 on either side.

The frontal portion of the lid 14 is emplaced in such a manner so that it can then rest on the upper surface of the pan 12. In particular, it rests on the interior pan wall surface 30 around the periphery.

The lid 14 is then captured between the cover 10 and pan 12 by keys 60 and 62. The extensions, L shaped flanges, or keys extend between the cover 10 and the pan 12 in intermediate relieved portion 48 which serves to form a keyway between stops 50 and 52. This is accomplished by turning the lid 14 upwardly in the direction of arrow C. At this point, when the lid 14 is turned upwardly in the direction of arrow C it is then ready to be placed on top of the pan 12 with the cover 10 securing it in place for proper movement backwardly and forwardly in the keyway provided between the cover and pan.

This can be seen in greater detail as to the securement of the notch 200 and 202 areas riding on the cover 10 on grooves 107, with the lid 14 at its forward end riding on the pan 12 yet captured by the cover 10 overlaying it at its L shaped or key extension portions 60 and 62.

The lid 14 and cover 10 are assembled on top of the pan 12 and provide for easy removal and cleaning through the three part relationship of the cover 10, lid 14, and pan 12.

What is claimed is:

1. A food pan and cover comprising:

a food pan with a peripheral web;

a cover which removably seats on said web having an opening in said cover;

a sliding lid having a downwardly extending sidewall overlying said opening having a portion which is mounted for sliding on said cover; and, a second portion of said lid for sliding on said pan.

2. The pan and cover as claimed in claim 1 further comprising:

said cover having side walls which receive in part said downwardly extending sidewall of said lid.

3. The pan and cover as claimed in claim 1 further comprising:

a rail on said cover; and, a flange on said lid for seating on said rail for supporting said lid in part.

4. The pan and cover as claimed in claim 1 further comprising:

a keyway formed between said cover and said pan; and, a key on said lid for support and sliding movement in said keyway.

5. The pan and cover as claimed in claim 4 further comprising:

stops at either end of said keyway to check sliding movement of said lid.

6. The pan and cover as claimed in claim 1 further comprising:

a wall substantially surrounding said lid on the upper surface thereof; and, a conduit in said lid wall extending beyond the opening of said cover for removal of liquid therefrom without entering said pan through the opening in said cover.

7. The pan and cover as claimed in claim 1 further comprising:

a relieved portion in said downwardly extending sidewall of said lid for turning movement of said lid in the opening of said cover to seat the lid on said cover around said opening.

8. A cover for a food pan having a seat for receiving said cover comprising:

a cover having a periphery for removably seating on said food pan;

an opening in said cover;

a lid in said opening adapted in part for seating on said cover and having a key for slidably seating between said cover and said pan; and, a support flange on said lid distal from said key for supporting said lid for sliding movement on said cover.

9. The cover as claimed in claim 8 further comprising;

said support flange on said lid extends over the surface of said cover beyond the periphery of said opening in said cover.

10. The cover as claimed in claim 9 further comprising:

a rail on said cover for receiving said support flange of said lid.

11. The cover as claimed in claim 8 further comprising:

a wall surrounding said lid having a drainage conduit extending beyond the opening of said cover.

12. The cover as claimed in claim 11 wherein:

said conduit is formed on said support flange which is formed as an arcuate flange extending beyond the opening of said cover.

13. The cover as claimed in claim 12 further comprising:

a stop on said cover for checking movement of said, lid when it is closed.

14. The cover as claimed in claim 8 further comprising:

a stop for said key on said cover to limit forward and rearward sliding movement of said lid on said cover.

15. The combination of a food pan and cover comprising:

a food pan having upright walls and a base forming the bottom of said pan;

a web around the periphery of said pan;

a cover for removably seating on the web of said pan having an opening therein; and, a lid for seating over the opening on said cover supported at one portion on said cover and at a distal portion on said pan, said lid having a downwardly sloping sidewall which seats over said cover when said lid closes said opening and under said cover in part when said lid is slid to open said opening.

16. The combination as claimed in claim 15 further comprising:

a space between said cover and said pan forming a keyway for receiving a portion of said lid for slidable movement between said cover and said pan.

17. The combination as claimed in claim 16 further comprising:

an extension from said lid for seating in said keyway.

18. The combination as claimed in claim 15 further comprising:

said lid is supported on said cover by a flange extending beyond the opening of said cover.

19. The combination as claimed in claim 18 further comprising:

a wall substantially surrounding said lid having a conduit overlying said support flange on said lid for draining the top of said lid.

20. The combination as claimed in claim 19 further comprising:

a rail on said cover for slidingly receiving said support flange of said lid upon which said lid rests.

21. The combination as claimed in claim 16 further comprising:

said keyway having stops for limiting the movement of said lid along said keyway.

22. The combination as claimed in claim 15 further comprising:

a notch in the side portion of said lid for placing and turning said lid in the opening of said cover.

* * * * *